US005946015A

United States Patent [19]

Courtney

[11] Patent Number: 5,946,015

[45] Date of Patent: Aug. 31, 1999

[54] METHOD AND APPARATUS FOR AIR REMOVAL FROM INK JET PRINTHEADS

[75] Inventor: Thomas P. Courtney, Fairport, N.Y.

[73] Assignee: Xerox Corporation, Stamford, Conn.

[21] Appl. No.: 08/867,642

[22] Filed: Jun. 2, 1997

[51] Int. Cl.[6] ..... B41J 2/19

[52] U.S. Cl. ..... 347/92; 347/30

[58] Field of Search ..... 347/29, 30, 32, 347/92, 85, 86, 87

[56] References Cited

U.S. PATENT DOCUMENTS

| | | | |
|---|---|---|---|
| 5,159,348 | 10/1992 | Dietl et al. | 347/85 |
| 5,339,102 | 8/1994 | Carlotta | 347/32 |
| 5,657,058 | 8/1997 | Mochizuki et al. | 347/92 |

*Primary Examiner*—N. Le
*Assistant Examiner*—Anh T. N. Vo
*Attorney, Agent, or Firm*—Robert A. Chittum

[57] ABSTRACT

A method and apparatus for removing or relocating relatively small air pockets from the reservoirs of ink jet printheads through the use of a decompression technique. In one embodiment, an ink jet cartridge, after being filled with ink, is subjected to a relatively high vacuum by being placed in an evacutable container which is connected to a high vacuum source. The container may hold several cartridges for concurrent processing. In another embodiment, an accessory kit may be used to provide the same decompression process while the cartridge is installed in the printer and located at its maintenance station. The accessory kit could be incorporated into the printer.

13 Claims, 6 Drawing Sheets

METHOD AND APPARATUS FOR AIR REMOVAL FROM INK JET PRINTHEADS

BACKGROUND OF THE INVENTION

The present invention relates to ink jet printing apparatus and is concerned, more particularly, with preventing deterioration of print quality by ink jet printers by removal of air from printheads of the printing apparatus.

For sustained quality printing by drop-on-demand ink jet printers, it is well known that the printheads of the printers should be free of air pockets or bubbles, the printhead nozzle faces should be cleaned periodically, the printhead nozzle faces should be capped when the printer is not in use. If air bubbles or air pockets form inside the printheads, especially in the ink manifolds or reservoirs leading to the nozzles, they may reduce print quality, if sufficient in size, because the air pockets cause restricted ink flow. This restriction slows the refill of the passageways or channels to the nozzles to the point where droplet ejecting stability is severely compromised. Air is generally removed by priming the printhead at a maintenance station, such as for example, as disclosed in U.S. Pat. No. 5,404,158. However, in many instances, the air pockets remain even though ink is withdrawn from printhead. Dried ink residue and paper fibers, dust, and other foreign material can collect on the printhead nozzle face and affect droplet directionality, so that the printhead nozzle face should be cleaned periodically by, for example, a wiper blade as disclosed in U.S. Pat. Nos. 4,853,717 and 5,404,158. Capping the printhead nozzles is intended to prevent the ink exposed in the printhead nozzles from drying out. As disclosed in U.S. Pat. No. 5,339,102, the printhead nozzle face may be capped when the printer is not printing by, for example, moving the printhead from a printing zone to a maintenance station where movement of the carriage carrying the printhead causes the printhead nozzle face to be automatically capped. In U.S. Pat. No. 5,339,102, the attempt to remove air bubbles from the printhead is done by a priming operation, while the printhead nozzle face is capped at the maintenance station. Unfortunately, the withdrawal of ink does not always remove the air pockets from the printhead reservoir, with the result that some nozzles are starved of ink and fail to eject ink droplets.

SUMMARY OF THE INVENTION

In one aspect of the invention, there is provided a method of removing air from an ink jet printhead having a plurality of droplet emitting nozzles in fluid communication with an ink reservoir through capillarily filled channels, the printhead reservoir having an inlet sealingly attached to an ink filled supply cartridge which is vented to the atmosphere through a vent, the reservoir inlet having less flow resistance than the channels, the method comprising the steps of: applying a vacuum to the printhead nozzles and cartridge vent from a high vacuum source; increasing the vacuum from the vacuum source to a predetermined value, so that any pockets of ambient air within the printhead and cartridge expand in size; using the lower flow resistance of the reservoir inlet to move the expanding air pocket in the printhead reservoir through the reservoir inlet into the cartridge rather than through the channels; merging the expanding air pocket from the printhead reservoir with any expanding air pocket in the cartridge; and removing the vacuum applied to the printhead nozzles and cartridge vent thereby shrinking the air pockets and reducing the air pockets to ambient air conditions in the cartridge and leaving the printhead reservoir free of air pockets.

In one embodiment of the invention, the above mentioned method is conducted on the ink supply cartridge with integral printhead when the air pockets or bubbles in the printhead reach a size which is about 30% of the volume of a printhead reservoir. The vent of the ink supply cartridge has means for connecting a hose thereto. When the ink supply cartridge is installed on a translatable carriage of an ink jet printer, the ink supply cartridge may be translated back and forth across a recording medium in a printing zone or periodically translated to a maintenance station of the printer, whereat the printhead nozzles are capped by a cap. The maintenance station cap is connected to a low vacuum source and selectively opened thereto by a pinch valve. Prior to initiating the method for removing air from the printhead, means is provided to connect the cap and ink supply cartridge vent to the high vacuum source so that the air removal method can be conducted in situ in the printer, as well as during the final step of manufacture.

BRIEF DESCRIPTION OF THE DRAWINGS

The present invention will now be described by way of example with reference to the accompanying drawings, in which like reference numerals refer to like elements, and wherein.

DESCRIPTION OF THE PREFERRED EMBODIMENT

Figure 1:
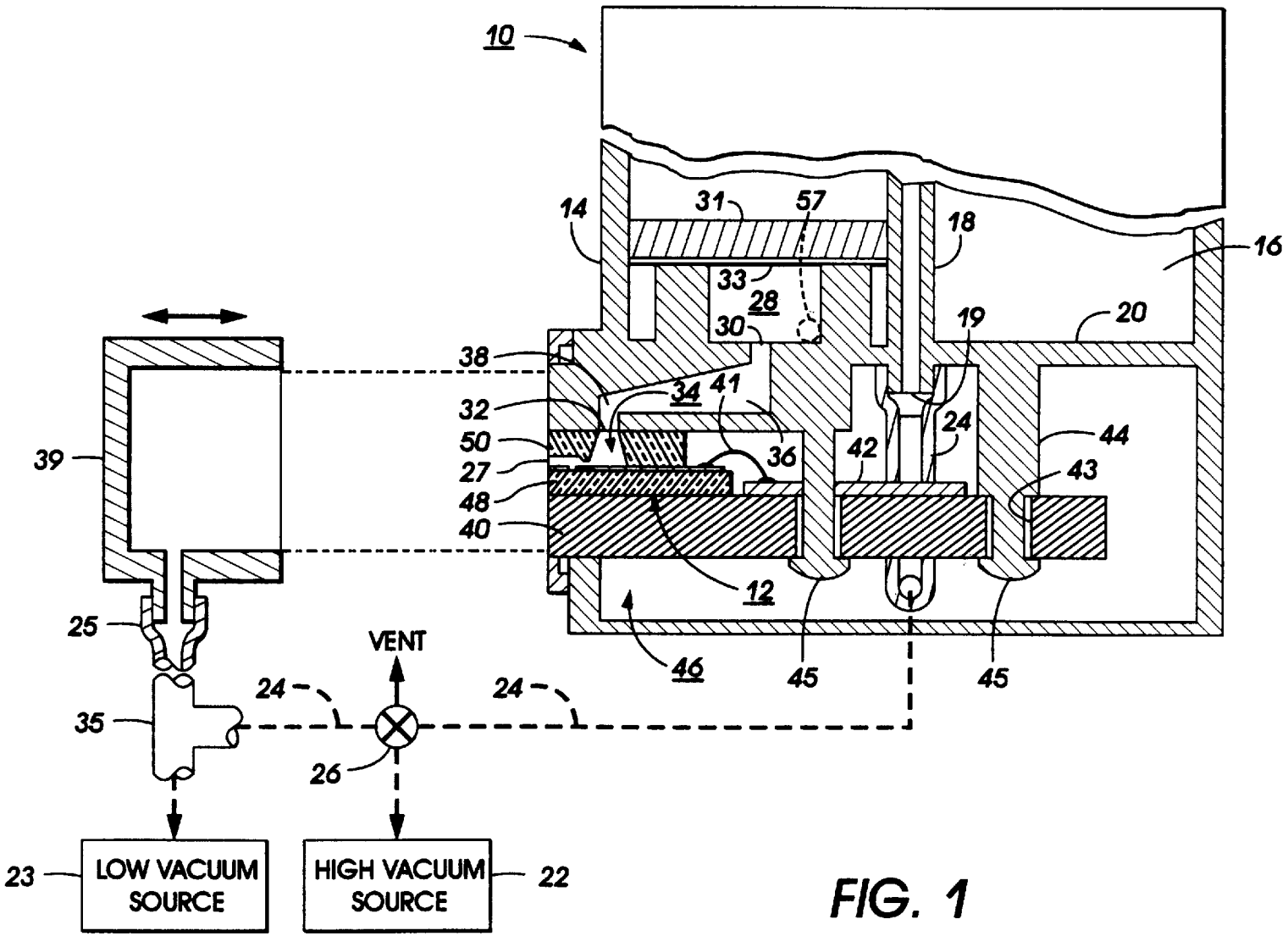
FIG. 1 is a schematic, partially shown and partially sectioned, side elevation view of an ink cartridge having an integrally attached printhead showing the air removal apparatus for one embodiment of the present invention.

In FIG. 1, a disposable ink cartridge 10 with integral printhead 12 is shown, similar to the cartridge disclosed in U.S. Pat. No. 5,519,425, which patent is incorporated herein by reference. The cartridge comprises a housing 14 typically made of a lightweight, durable plastic which defines a chamber 16 for storing ink in a first absorbent material (not shown) contained therein, such as, for example, a needled polyester felt. The chamber is hermetically sealed except for the sealed ink flow path to the printhead nozzles, discussed later, and a vent 18 that penetrates the chamber floor 20 and is open to the atmosphere. The vent may optionally be connectable via appropriate conduits 24 and valve 26 to a high vacuum source 22, which may be an integral part of the printer or a separate accessory, as discussed later. The vent in this optional embodiment is open to the atmosphere when the printer is in the printing mode and closed to the atmosphere by the valve when the cartridge is to be subjected to a vacuum from the high vacuum source. A recess or well 28 is integrally formed in the chamber floor and contains an opening or output port 30 which is connected to a transitioning passageway having an outlet 38 that is aligned with and sealed to the inlet 32 of the printhead reservoir 34. A second absorbent member 31, having a capillary force greater than the first absorbent material, covers the open end of the well 28. Optionally, a filter 33 is sandwiched between the second absorbent member and the open end of the well 28. The transitioning passageway 36 is geometrically shaped to provide a minimized ink flow resistance and its shape assists in movement of air bubbles therefrom to the cartridge well 28. The transitioning passageway is better seen in FIG. 2, shown isometrically in phantom line.

The printhead 12 and a circuit board 42 are bonded to a heat sink 40 and are electrically connected by wire bonds 41 to form a printhead assembly 46 that is attached to the cartridge housing 14 by stake pins 44 which are integrally formed with the cartridge housing and which are inserted through alignment holes 43 in the heat sink. The stake pins are ultrasonically staked to form fastening heads 45 that fixedly attach the printhead assembly to the cartridge with the printhead reservoir inlet aligned with and sealed to the passageway outlet 38.

Figure 2:
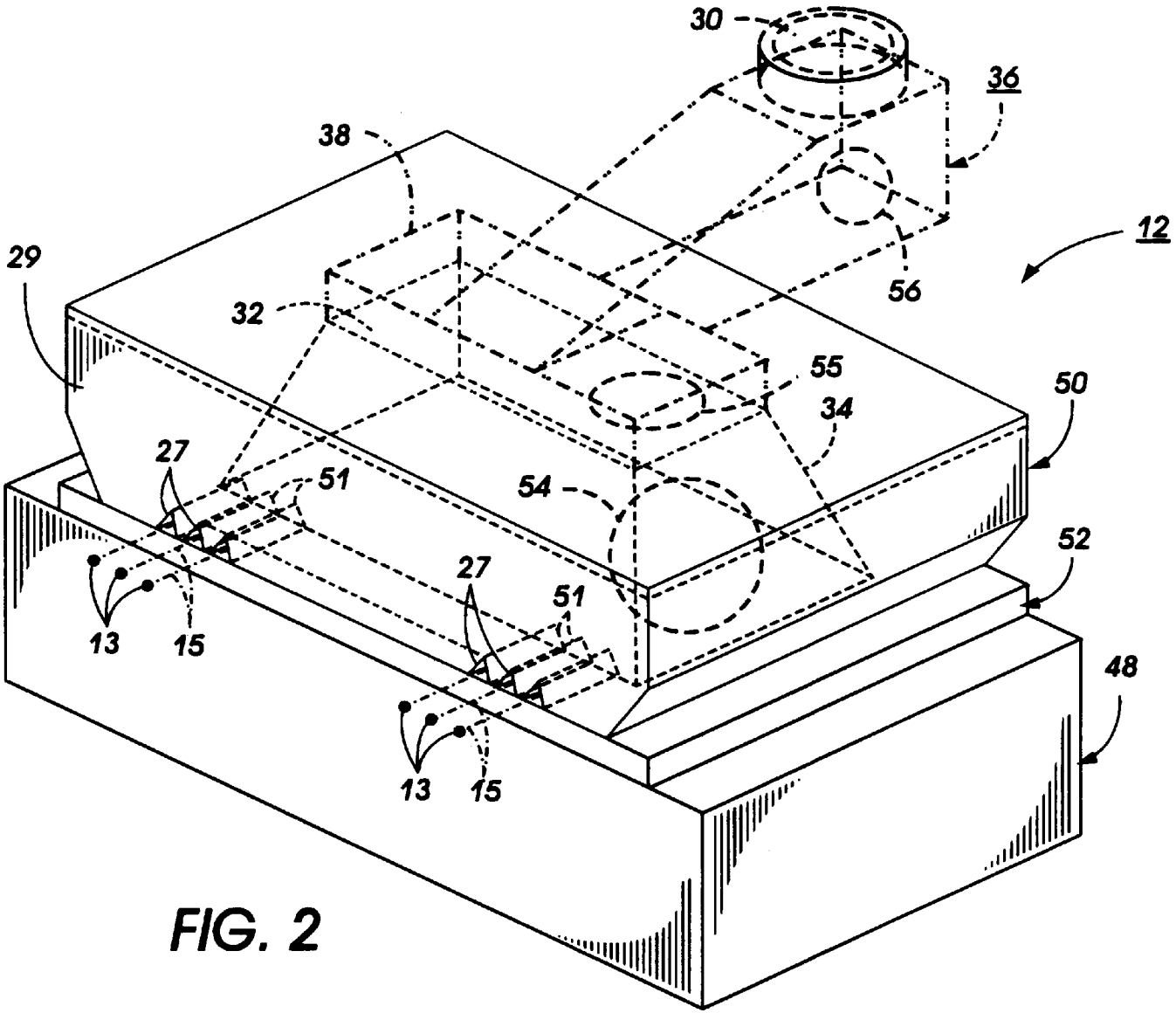
FIG. 2 is a schematic isometric view of the printhead showing the ink flow passageway between the ink supply cartridge and the printhead inlet and air pockets therein.

An enlarged schematic isometric view of the printhead 12 is shown in FIG. 2. The printhead comprises a heater plate 48 having heating elements and addressing electrodes (not shown) and a channel plate 50 having a parallel array of channels 51 (shown in dashed line), one end of which open through the printhead front face 29 and serve as nozzles 27, and a reservoir 34 (shown in dashed line) with inlet 32. The reservoir is in fluid communication with the ends of the channels opposite the channel ends serving as nozzles. A thick film layer 52 such as, for example, polyimide is deposited over the surface of the heater plate containing the heating elements and electrodes and patterned to remove the thick film layer over the heating elements and electrode terminals (not shown), thus placing the heating elements in a pit (not shown) and enabling the wire bonding of the electrode terminals to the printed circuit board 42 (see FIG. 1). The channel plate is bonded to the thick film layer with a heating element in each channel as disclosed in U.S. Pat. No. 4,774,530, which patent is incorporated herein by reference. For illustration purposes, droplets 13 ejected from the nozzles are shown following trajectories 15.

As mentioned above, the transitioning passageway 36 in the chamber floor of the cartridge is shown in phantom line for ease of understanding the location of air pockets or bubbles 55, 56 therein. An air pocket 54 is shown in phantom line in the printhead reservoir, and an air pocket 57 is shown in phantom line in the cartridge well 28 (see FIG. 1). Air bubbles or pockets often form inside of thermal ink jet printhead reservoirs as a result of the initial filling of the cartridge chamber 16 with ink and the priming of the printhead. These air bubbles or pockets in the printhead reservoir 34 do not impact print quality until they increase in size such that the ratio of the air pocket volume to printhead reservoir volume is about 30% or almost 1 to 3. If the air pockets 54 in the reservoirs become of a sufficient size, they will cause local ink flow restriction of the ink into the adjacent channels. This flow restriction slows the channel refill process to the point that droplet ejection is prevented from the nozzles of the affected channels. Once the air pockets or bubbles are removed from the printhead reservoirs, the air pockets in the transitioning passageway 36 and cartridge well 28 do not impact print quality, for they do not restrict flow to the channels and the channel nozzles.

As disclosed in U.S. Pat. No. 5,339,102, it is well known to provide a maintenance station to provide a means of selectively capping the printhead nozzles with a cap when the printer is not in the printing mode. While capped, the printhead nozzles may be maintained in a humid environment to prevent the exposed ink in the nozzles from drying out, permits the ejection of ink droplets into the cap to prevent slugs of more viscous ink from forming in the nozzles, and to enable the priming of the printhead by subjecting the nozzles to a suction to withdraw ink and suck out any air bubbles that are present with the ink. In the '102 patent, the cap is selectively connected to a low vacuum source of about 120 inches of water for a short period of time. The larger air pockets in the printhead reservoirs are removed by such procedure, but at the cost of lost of ink from the fixed supply in the cartridge. Though this priming operation generally maintains the print quality, it has been found not to totally remove the smaller air pockets that most times reside in the printhead reservoirs. The air pockets in the printhead reservoir become larger with time and usage, thus requiring periodic priming to maintain suitable print quality and the wasting of ink.

By removing the air pockets from the reservoirs 34 of the printheads after being initially filled, the reservoirs tend to stay free of any air pocket, even during usage. In accordance with one embodiment of the present invention, by subjecting the ink filled cartridge 10 to a high vacuum of about 0.1 pounds per square inch absolute (psia), the air pockets 54 in the printhead reservoirs are relocated or moved to a position outside the printhead. Referring to FIGS. 3–9, micrographic x-rays of the ink containing volume of the cartridge well 28, transitioning passageway 36, and printhead reservoir 34 are schematically depicted at instantaneous times $t_0$ to $t_5$ to show the stages of removal or relocation of air pockets 54 from the reservoir 34 under the high vacuum.

Figure 3:
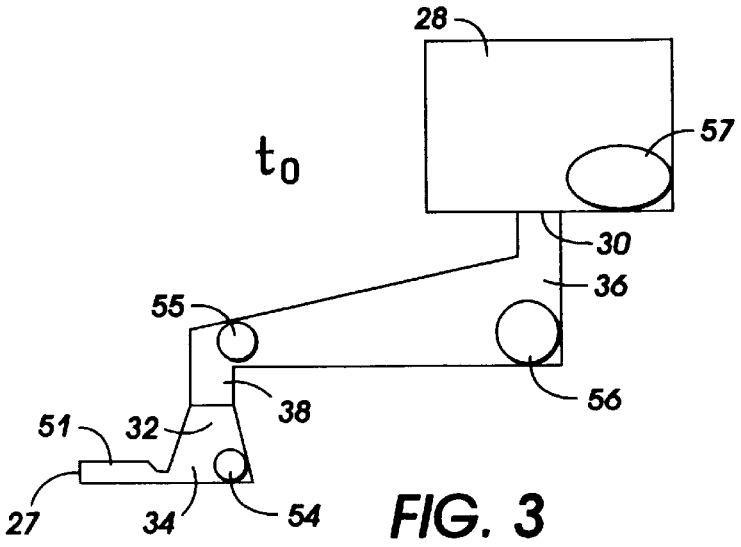
FIGS. 3 to 8 schematically show the removal progress of an air pocket in the printhead reservoir with time during a vacuum decompression of the cartridge.
Figure 4:
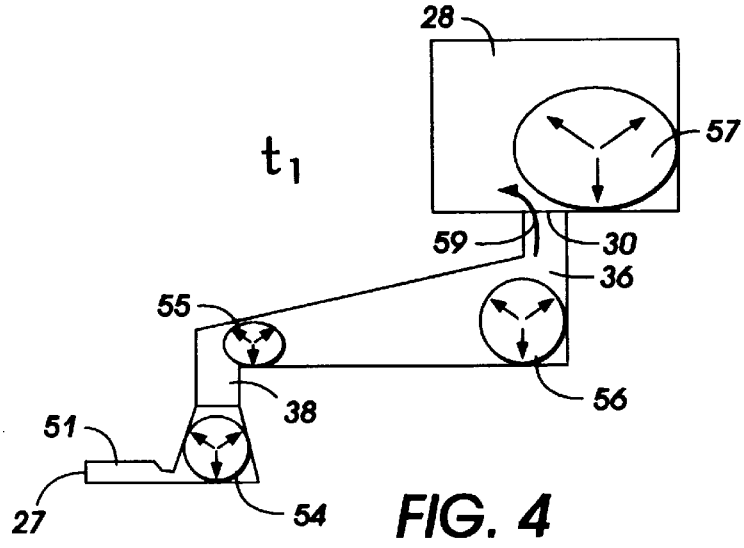
Figure 5:
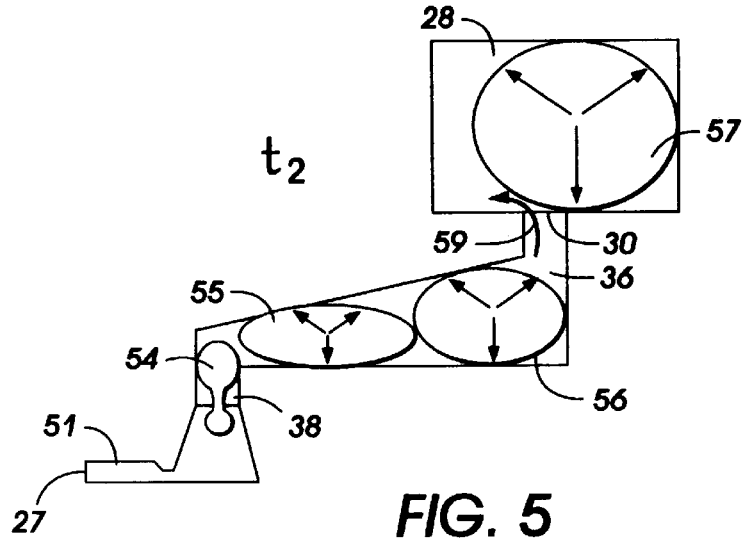
Figure 6:
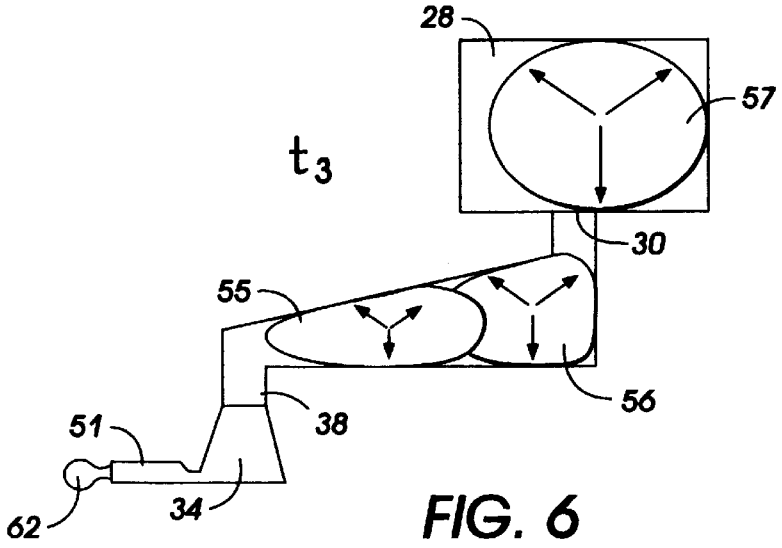
Figure 7:
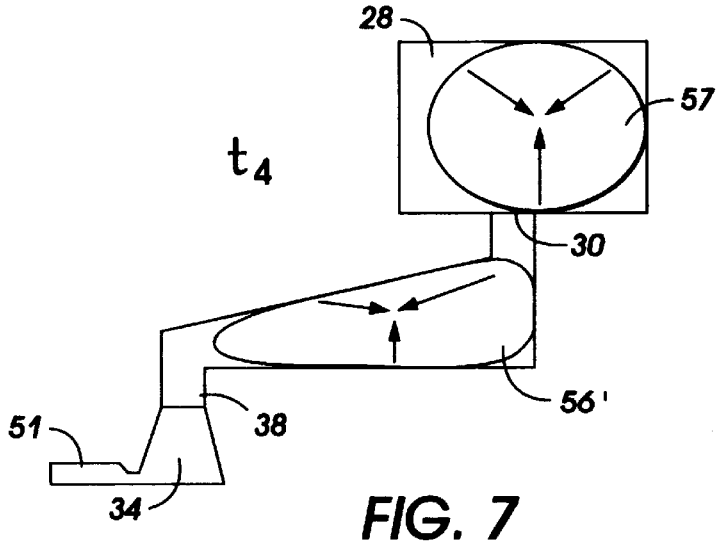
Figure 8:
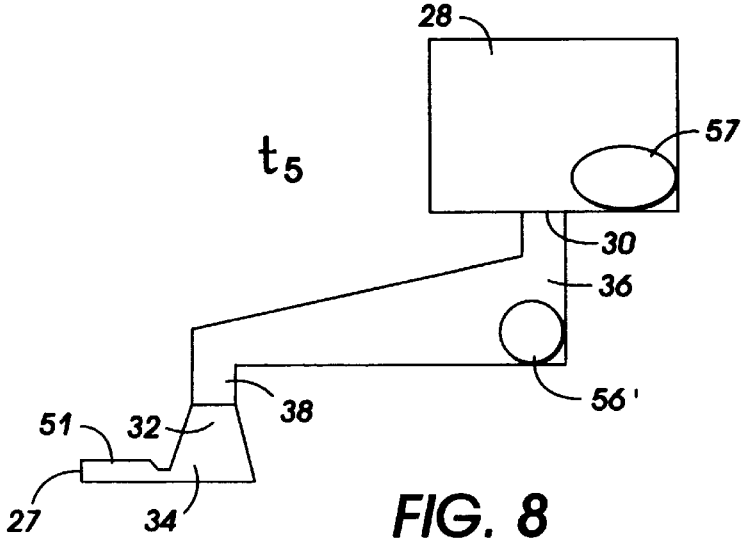
Figure 9:
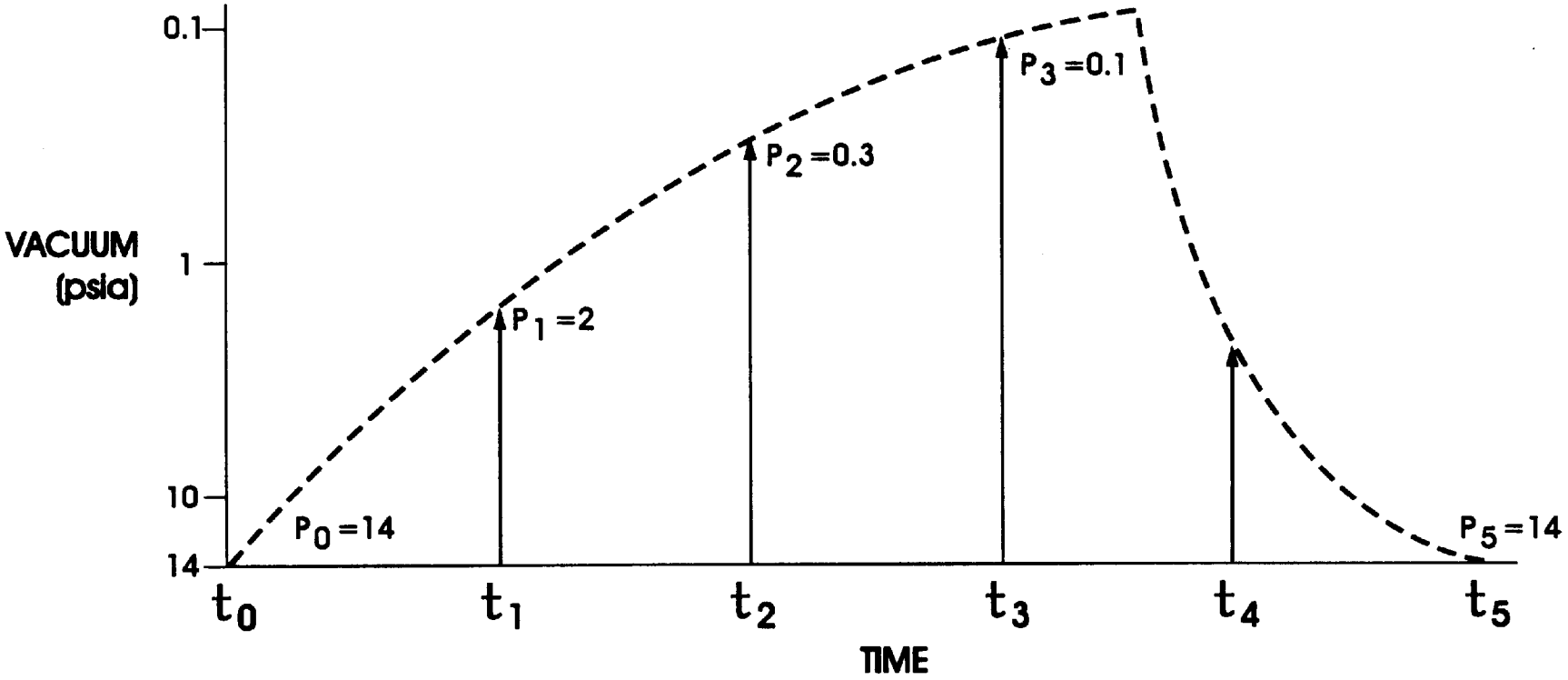
FIG. 9 shows a graph of the vacuum in pounds per square inch absolute (psia) applied to the cartridge relative to FIGS. 3 to 8.
Figure 10:
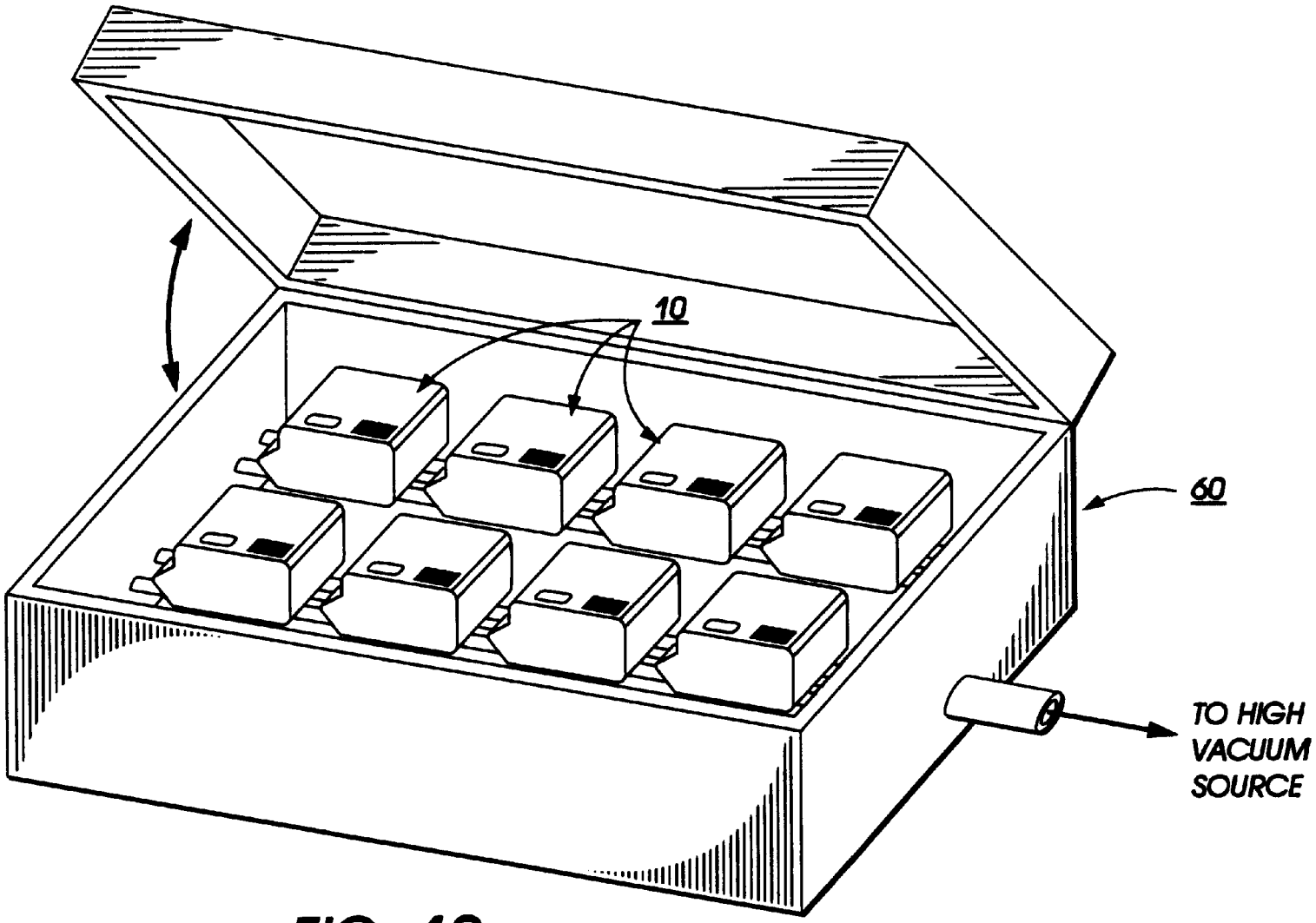
FIG. 10 shows an other embodiment of the present invention wherein the air pockets are removed in a manufacturing step.

At time $t_0$, indicated in FIG. 3 and FIG. 9, an ink filled cartridge 10 is placed in an evacutable container 60. For commercial production, the container 60 would hold many cartridges, but, in FIG. 10, the container is shown holding a representative eight cartridges for air pocket removal from their printhead reservoirs concurrently. With the cartridge 10 beginning to be subjected to a high vacuum source 22, the pressure $P_1$ equals about 2 psia at time $t_1$, and the ambiently pressurized air pockets 54, 55, 56, and 57 begin to expand as shown in FIG. 4 and FIG. 9. The ink is moved in the direction of arrow 59 from the transitioning passageway 36 rather than out of the printhead nozzles because the flow resistance is less through the outlet port 30 of the cartridge well 28 than the flow resistance of the channels 51. As the vacuum continues to increase at time $t_2$ on the graph of FIG. 9 to a pressure $P_2$ equal to about 0.3 psia, the air pockets continue to grow as shown in FIG. 5. At pressure $P_2$, the air pocket 54 in the reservoir 34 begins to bulge through the reservoir inlet 32 and transitioning passageway outlet 38 and into the transitioning passageway 36, thereby taking the shape of a dumbbell. The movement of the ink in the direction of arrow 59 causes the air pocket 54 to expand into the transitioning passageway 36. At pressure $P_3$ and time $t_3$ in the graph shown in FIG. 9, the vacuum is about 0.1 psia and the air pockets are still expanding, but air pocket 55 in the region of the transitioning passageway outlet has combined with the air pocket 54 from the printhead reservoir 34, as shown in FIG. 6. At this stage, a slug 62 of ink is expelled from each of the nozzles. The ink slugs from each cartridge have about the volume of two or three of the normal ink droplets 13 ejected during the printing mode as shown in FIG. 1, which is much less than would be withdrawn by a priming operation. At time $t_4$ on the graph in FIG. 9, a time soon after the vacuum reaches the desired pressure of 0.1 psia, the high vacuum source has been removed from container 60 and as the pressure $P_4$ in the container increases, the air pockets begin to shrink, as shown in FIG.

7, with air pockets 55 and 56 being combined together as air pocket 56'. At time $t_5$, the pressure $P_5$ in the evacutable container 60 has returned to normal ambient pressure and air pocket 57 has returned to its original size, while air pocket 56' is slightly enlarged from its original size. The subjection of the filled cartridge to the high vacuum totally relocated air pocket 54 out of the reservoir 34 and the reservoir is left free of any air pocket. Subsequent testing of the cartridges which had the air pockets removed from their printhead reservoirs by the decompression process of subjecting them to a high vacuum showed that the air pockets in the other locations did not affect the printing quality and that the air pockets did not tend to return to the reservoirs.

In another embodiment of the invention, an accessory kit for use with an ink jet cartridge 10 after installation in the printer is also effective in removing or relocating air pockets from printhead reservoirs 34. Referring to FIG. 1, conduits or hoses 24 may be connected to the end 19 of vent 18 and the cap 39 of a maintenance station similar to the one disclosed in U.S. Pat. No. 5,339,102 and incorporated herein by reference. In the '102 patent, the cap is connected to a relatively low vacuum source by a flexible hose and pinch valve. In this embodiment, the flexible hose 25 which interconnects the cap 39 with the low vacuum source 23 is also connected to the multiple position valve 26, so the interior of the cap 39, when sealed against the cartridge to seal the nozzles 27 in face 29 of the printhead 12, and the vent end 19 is selectively exposed to the high vacuum from vacuum source 22. Because the cartridge is otherwise hermetically sealed, the high vacuum from the vacuum source 22 provides the same air pocket removal process as shown in FIGS. 3–8. Thus, the accessory kit comprises a hose tee 35, conduits 24, multiple position valve 26, and high vacuum source 22. In an alternate embodiment (not shown), the accessory kit is an integral part of the printer.

Many modifications and variations are apparent from the foregoing description of the invention, and all such modifications and variations are intended to be within the scope of the present invention.

I claim:

1. A method of removing print quality impairing air from an ink jet printhead having a plurality of droplet emitting nozzles, capillarily filled channels, and an ink reservoir, the nozzles being in fluid communication with the ink reservoir through the capillarily filled channels, the printhead reservoir having an inlet sealingly attached to an ink supply cartridge which is vented to the atmosphere through a vent in said cartridge, the reservoir inlet and the channels each having an ink flow resistance, and the reservoir inlet having less flow resistance than that of the channels, the method comprising the steps of:

(a) applying a vacuum to both the printhead nozzles and the cartridge vent from a high vacuum source;

(b) increasing the vacuum from the high vacuum source to a predetermined value, so that any pockets of air within the printhead and cartridge expand in size;

(c) using the less flow resistance of the reservoir inlet to cause any pockets of air in the printhead reservoir which expand under the predetermined value of the vacuum to move through the reservoir inlet into the cartridge rather than to move through the channels and out of the printhead nozzles;

(d) allowing any pockets of air from the printhead reservoir which expand and move into the cartridge to merge with any expanded air pocket in the cartridge; and (e) removing the high vacuum applied to the printhead nozzles and cartridge vent, thereby shrinking the air pockets and reducing the air pockets to ambient air conditions in the cartridge and leaving the printhead reservoir free of the air pockets.

2. The method as claimed in claim 1, wherein the predetermined value of the vacuum is 0.1 psia.

3. The method as claimed in claim 1, wherein the ink supply cartridge and printhead is subjected to the air pocket removal steps after fabrication and being filled with ink.

4. The method as claimed in claim 3, wherein the steps of claim 1 are conducted on the ink supply cartridge and the printhead, after installation thereof in the ink jet printer, if the air pockets in the printhead reach a size which begins to impair print quality by said printhead while the ink supply cartridge and printhead remain in the printer.

5. The method as claimed in claim 4, wherein the size of air pocket in the printhead which impairs print quality is when the size of the air pocket reaches a volume of about 30% of a printhead reservoir volume.

6. The method as claimed in claim 5, wherein the ink supply cartridge vent is adapted for a hose connection, and wherein the ink supply cartridge and printhead are installed on a translatable carriage in an ink jet printer for translation thereby across a printing zone and for periodic translation to a maintenance station of the ink jet printer whereat the printhead nozzles are enclosed by a cap, the cap having means for selectively placing the cap into fluid communication with a low vacuum source via a flexible hose; and wherein the method further comprises the steps of:

(f) prior to step (a), installing a hose tee in the flexible hose between the cap at the maintenance station and the low vacuum source;

(g) connecting a multiple position valve to the hose tee, the cartridge vent, and the vent to the atmosphere, the multiple position valve being selectively positionable to connect either the cap via the hose tee and the cartridge vent via the hose connection to the high vacuum source, or to close both the hose connecting the hose tee and the connection to the high vacuum source and concurrently connecting the vent to the atmosphere to the hose connection adapted to the cartridge vent, thereby venting the ink supply cartridge; and (h) positioning the multiple position valve to connect the cap and the cartridge vent to the high vacuum source, whereby the printhead nozzles and the ink supply cartridge vent are subject to the high vacuum source.

7. The method as claimed in claim 6, wherein the hose tee, the multiple position valve, the vent to the atmosphere, and the high vacuum source are a part of the ink jet printer.

8. The method as claimed in claim 6, wherein the hose tee, the multiple position value, the vent to the atmosphere, and the high vacuum source are a part of a separate accessory kit.

9. The method as claimed in claim 3, wherein said method of removing print quality impairing air from the ink jet printhead is conducted after placing one or more of said ink supply cartridges and said printheads in an evacutable container, with the ink reservoirs of said one or more printheads remaining sealingly attached to a respective one of said one or more ink supply cartridges.

10. A method of removing print quality impairing air from an ink jet printhead having a plurality of droplet emitting nozzles, capillarily filled channels, and an ink reservoir, the nozzles being in fluid communication with the ink reservoir by the channels, the ink reservoir of the printhead having an inlet which is sealingly attached to an ink supply cartridge, the cartridge having a vent, and the reservoir inlet and the channels each having an ink flow resistance, with the ink flow resistance of the reservoir inlet being less than the ink flow resistance of the channels, the method comprising the steps of:

(a) installing the cartridge and printhead on a translatable carriage of an ink jet printer having a printing zone and a maintenance station located to one side of the printing zone, the carriage being translatable in said printing zone and to said maintenance station, whereat the printhead nozzles are enclosed by a pivotable cap, the cap being connected to a low vacuum source via a flexible hose;

(b) providing a hose tee in the flexible hose;

(c) providing a high vacuum source;

(d) connecting a multiple position valve to the hose tee, the cartridge vent, and a separate vent to the atmosphere, the multiple position valve being selectively positionable (1) to connect the cap via the hose tee and the cartridge vent to the high vacuum source (2) to connect the cartridge vent and the cap to the separate vent to the atmosphere, or (3) to connect the cartridge vent to the separate vent to the atmosphere and to close the hose tee, so that the cap is connected to the low vacuum source;

(e) translating the cartridge and printhead to the maintenance station when air pockets in the printhead reservoir have increased in volume to impair print quality by the printhead, whereat the printhead nozzles are enclosed by said cap;

(f) positioning the multiple position valve to connect the cap via the hose tee and cartridge vent to the high vacuum source;

(g) applying a vacuum to both the printhead nozzles via the cap and the cartridge vent from said high vacuum source;

(h) increasing the vacuum from the high vacuum source to a predetermined value to cause any pockets of air within the printhead and cartridge to expand in volume;

(i) using the less flow resistance of the reservoir inlet to permit any pockets of air in the printhead reservoir which expand under the predetermined value of the vacuum to move through the reservoir inlet and into the cartridge rather than to move through the channels and out of the printhead nozzles;

(j) allowing any pockets of air from the printhead reservoir which have expanded and moved into the cartridge to merge with any expanded air pocket in said cartridge; and (k) removing the vacuum applied to the printhead nozzles and cartridge vent and positioning the multiple position valve to connect the cartridge vent and the cap to the separate vent to the atmosphere, thereby shrinking the air pockets and reducing the air pockets to ambient air conditions in the cartridge and leaving the printhead reservoir free of the air pockets.

11. The method as claimed in claim 10, wherein the printhead reservoir has a volume; and wherein the volume of the air pockets in the printhead reservoir which impair print quality is about 30% of the volume of the printhead reservoir.

12. The method as claimed in claim 10, wherein the hose tee, the multiple position valve, the vent to the atmosphere, and high vacuum source are a part of the ink jet printer.

13. The method as claimed in claim 10, wherein the hose tee, the multiple position value, the vent to the atmosphere, and the high vacuum source are a part of a separate accessory kit.

* * * * *